US008579678B2

(12) United States Patent
Omomoto

(10) Patent No.: US 8,579,678 B2
(45) Date of Patent: Nov. 12, 2013

(54) GRINDING METHOD FOR WORKPIECE HAVING A PLURALITY OF BUMPS

(75) Inventor: Masahumi Omomoto, Ota-Ku (JP)

(73) Assignee: Disco Corporation, Tokyo (JP)

( * ) Notice: Subject to any disclaimer, the term of this patent is extended or adjusted under 35 U.S.C. 154(b) by 266 days.

(21) Appl. No.: 13/103,463

(22) Filed: May 9, 2011

(65) Prior Publication Data

US 2011/0281504 A1 Nov. 17, 2011

(30) Foreign Application Priority Data

May 11, 2010 (JP) ..... 2010-108921

(51) Int. Cl.
*B24B 1/00* (2006.01)

(52) U.S. Cl.
USPC ..... 451/41; 451/385; 451/387; 451/365

(58) Field of Classification Search
USPC ..... 451/365, 384, 385, 390, 41, 42
See application file for complete search history.

(56) References Cited

U.S. PATENT DOCUMENTS

| | | | | |
|---|---|---|---|---|
| 2,466,610 | A * | 4/1949 | Newman | 451/385 |
| 3,449,870 | A * | 6/1969 | Jensen | 451/36 |
| 3,453,783 | A * | 7/1969 | Queen | 451/390 |
| 4,081,928 | A * | 4/1978 | Kinnebrew et al. | 451/288 |
| 4,104,099 | A * | 8/1978 | Scherrer | 156/155 |
| 4,132,037 | A * | 1/1979 | Bonora | 451/288 |
| 4,165,584 | A * | 8/1979 | Scherrer | 451/289 |
| 4,239,567 | A * | 12/1980 | Winings | 156/154 |
| 4,316,757 | A * | 2/1982 | Walsh | 156/286 |
| 4,512,113 | A * | 4/1985 | Budinger | 451/397 |
| 4,519,168 | A * | 5/1985 | Cesna | 451/41 |
| 5,193,316 | A * | 3/1993 | Olmstead | 451/63 |
| 5,573,448 | A * | 11/1996 | Nakazima et al. | 451/41 |
| 5,788,560 | A * | 8/1998 | Hashimoto et al. | 451/288 |
| 7,459,397 | B2 * | 12/2008 | Washino et al. | 438/692 |
| 2005/0250334 | A1 * | 11/2005 | Washino et al. | 438/692 |
| 2007/0184755 | A1 * | 8/2007 | Park | 451/11 |

FOREIGN PATENT DOCUMENTS

JP 11-307620 11/1999

* cited by examiner

*Primary Examiner* — Lee D Wilson
*Assistant Examiner* — Tyrone V Hall, Jr.
(74) *Attorney, Agent, or Firm* — Greer, Burns & Crain, Ltd.

(57) ABSTRACT

A grinding method of grinding the back side of a workpiece having a projection on the front side thereof. The grinding method includes a holding jig preparing step of preparing a holding jig having a circular recess and an annular projection surrounding the circular recess, a setting step of setting the workpiece in the circular recess of the holding jig with the back side of the workpiece exposed, a liquid curing agent supplying step of supplying a liquid curing agent into the circular recess (either before or after the setting step), a fixing step of curing the liquid curing agent with the workpiece set in the circular recess and the liquid curing agent present in the circular recess, thereby fixing the workpiece in the circular recess, and a grinding step of grinding the back side of the workpiece and the annular projection of the holding jig by using grinding means.

5 Claims, 9 Drawing Sheets

GRINDING METHOD FOR WORKPIECE HAVING A PLURALITY OF BUMPS

BACKGROUND OF THE INVENTION

1. Field of the Invention

The present invention relates to a grinding method of grinding the back side of a wafer or chip having a bump on the front side thereof.

2. Description of the Related Art

In a semiconductor device fabrication process, a plurality of crossing division lines called streets are formed on the front side of a silicon wafer or compound semiconductor wafer to thereby partition a plurality of regions where devices such as ICs and LSIs are respectively formed. The back side of the wafer is ground to reduce the thickness of the wafer to a predetermined thickness. Thereafter, the wafer is divided along the division lines to obtain individual semiconductor devices.

A grinding apparatus called a grinder is widely used to grind the back side of a wafer. The grinder includes a chuck table for holding a workpiece and grinding means opposed to the chuck table. In grinding the workpiece, a protective tape as disclosed in Japanese Patent Laid-open No. Hei 11-307620, for example, is attached to the front side of the workpiece, so as to protect the devices formed on the front side of the workpiece. The workpiece is held under suction through the protective tape on the chuck table of the grinder in the condition where the back side of the workpiece is exposed, and the back side of the workpiece is ground by abrasive members included in the grinding means.

As a technique for realizing a reduction in size and weight of a semiconductor device, a mounting method called flip-chip bonding has been put into actual use in recent years. In such flip-chip bonding, a plurality of metal projections called bumps each having a height of about 10 to 100 μm are formed on the front side of the device, and these bumps of the device are opposed to electrodes formed on a wiring board and bonded directly to the electrodes.

SUMMARY OF THE INVENTION

However, in the case that the protective tape is attached to a wafer having bumps each having a height of 100 μm, for example, a space is formed between the protective tape and the wafer, and the wafer is fixed through only the bumps to the protective tape. Accordingly, when the back side of the wafer is ground in this condition, stress is applied to the bumps, causing damage to the wafer.

It is therefore an object of the present invention to provide a grinding method which can grind the back side of a workpiece having a projection on the front side thereof without damaging the workpiece.

In accordance with an aspect of the present invention, there is provided a grinding method of grinding the back side of a workpiece having a projection on the front side thereof, the grinding method including a holding jig preparing step of preparing a holding jig having a circular recess and an annular projection surrounding the circular recess; a setting step of setting the workpiece in the circular recess of the holding jig in the condition where the back side of the workpiece is exposed; a liquid curing agent supplying step of supplying a liquid curing agent into the circular recess before or after performing the setting step; a fixing step of curing the liquid curing agent in the condition where the workpiece is set in the circular recess and the liquid curing agent is present in the circular recess, thereby fixing the workpiece in the circular recess; and a grinding step of grinding the back side of the workpiece and the annular projection of the holding jig by using grinding means after performing the fixing step.

Preferably, the workpiece includes a chip having a plurality of electrodes projecting from the front side thereof. Preferably, the holding jig includes a silicon wafer.

According to the grinding method of the present invention, the workpiece having the projection on the front side thereof is fixed to the holding jig having the circular recess and the annular projection surrounding the circular recess by curing the liquid curing agent. The liquid curing agent supplied into the circular recess does not flow out of the circular recess because the annular projection functions as a bank. Accordingly, by filling the space between the lower surface of the workpiece and the lower end of the projection with the liquid curing agent and then curing the liquid curing agent, the workpiece can be firmly fixed to the holding jig. Accordingly, stress concentration at the projection in grinding the back side of the workpiece can be prevented to thereby prevent damage to the workpiece in the grinding step.

The above and other objects, features and advantages of the present invention and the manner of realizing them will become more apparent, and the invention itself will best be understood from a study of the following description and appended claims with reference to the attached drawings showing some preferred embodiments of the invention.

DETAILED DESCRIPTION OF THE PREFERRED EMBODIMENT

Figure 1:
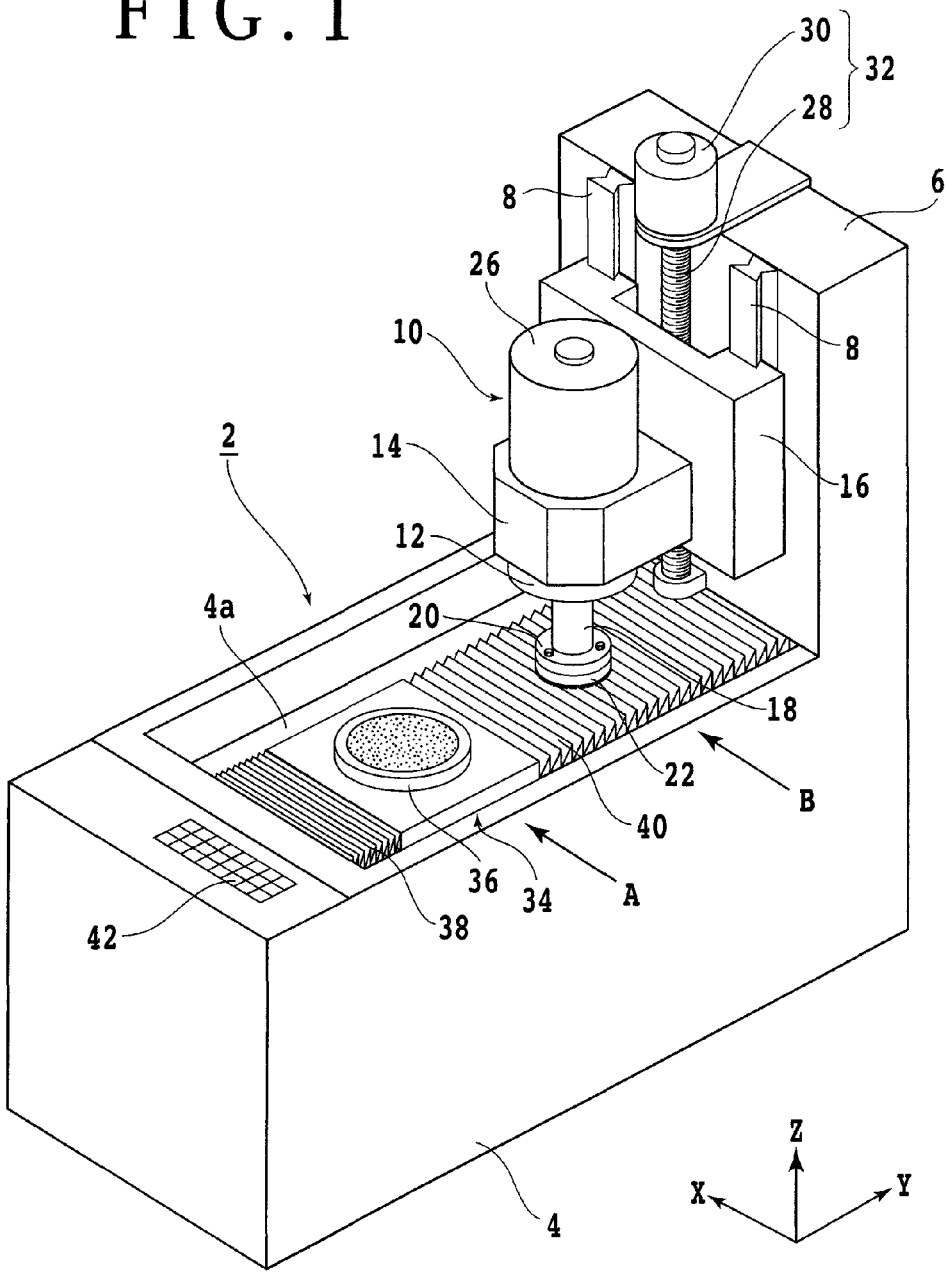
FIG. 1 is a perspective view of a grinding apparatus.

A preferred embodiment of the present invention will now be described in detail with reference to the drawings. Prior to the description of a grinding method according to the present invention, there will now be described a manufacturing method for a holding jig used in the grinding method with reference to FIGS. 1 to 4. FIG. 1 is a schematic perspective view of a grinding apparatus 2 used in manufacturing the holding jig. The grinding apparatus 2 includes a base 4 having a column 6 vertically extending at the rear end. A pair of vertically extending guide rails 8 are fixed to the front surface of the column 6.

A grinding unit (grinding means) 10 is mounted on the column 6 so as to be vertically movable along the guide rails 8. The grinding unit 10 includes a housing 12 and a support member 14 for supporting the housing 12. The support member 14 is mounted on a moving base 16 vertically movable along the guide rails 8. The grinding unit 10 includes a spindle 18 rotatably accommodated in the housing 12, a mounter 20 fixed to the lower end of the spindle 18, a grinding wheel 22 mounted on the lower surface of the mounter 20 by screws, the grinding wheel 22 having a plurality of abrasive members annularly arranged, and a servo motor 26 for rotating the spindle 18.

The grinding apparatus 2 further includes a grinding unit moving mechanism 32 for vertically moving the grinding unit 10 along the guide rails 8. The grinding unit moving mechanism 32 is composed of a ball screw 28 threadedly engaged with the moving base 16 for vertically moving the moving base 16 along the guide rails 8 and a pulse motor 30 for rotating the ball screw 28. Accordingly, when the pulse motor 30 is driven, the ball screw 28 is rotated to thereby vertically move the moving base 16.

The upper surface of the base 4 is formed with a recess 4*a*, and a chuck table mechanism 34 is provided in the recess 4*a*. The chuck table mechanism 34 has a chuck table 36. The chuck table 36 is movable in the Y direction by a moving mechanism (not shown) to selectively take a wafer mounting/demounting position A set on the front side of the grinding unit 10 as shown in FIG. 1 and a grinding position B opposed to the grinding unit 10 on the lower side thereof. A pair of bellows 38 and 40 are provided on the front and rear sides of the chuck table 36. Further, an operation panel 42 allowing the input of grinding conditions or the like by an operator of the grinding apparatus 2 is provided on the upper surface of the front end portion of the base 4.

The manufacturing method for the holding jig by the use of the grinding apparatus 2 shown in FIG. 1 will now be described, wherein the holding jig is manufactured by grinding a wafer at its central portion to form a circular recess and accordingly leave an annular projection around the circular recess. The holding jig is formed from a silicon wafer 11 obtained by slicing a silicon ingot, for example. The silicon wafer 11 has a thickness of 700 μm, for example.

Figure 2:
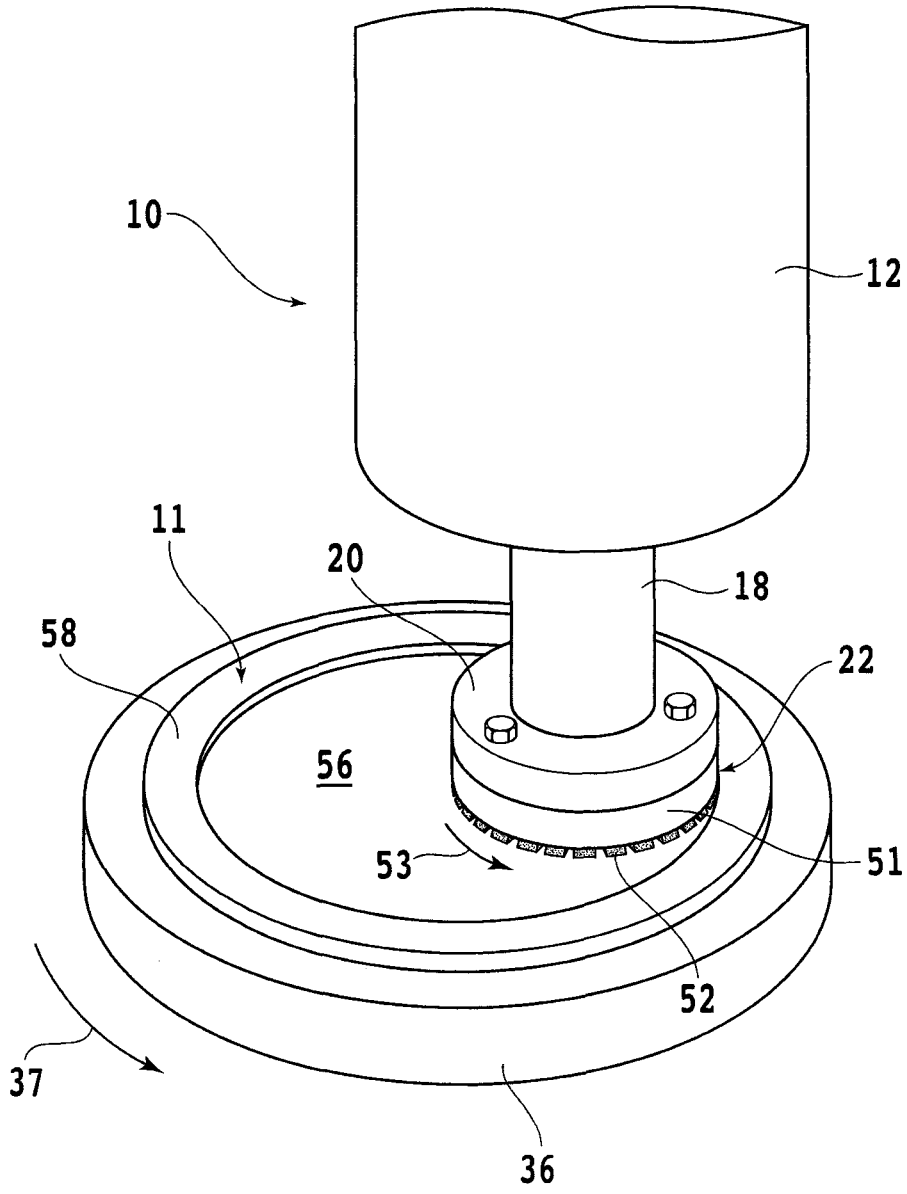
FIG. 2 is a perspective view showing a method of manufacturing a holding jig by using the grinding apparatus shown in FIG. 1.
Figure 3:
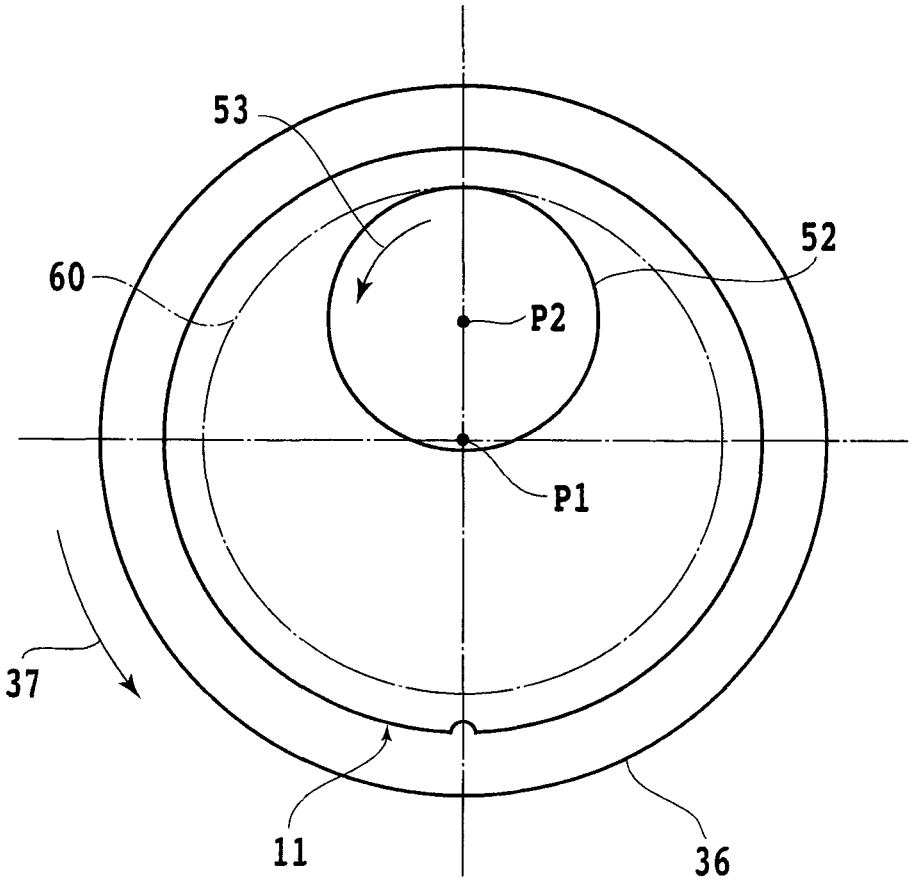
FIG. 3 is a schematic plan view for illustrating the holding jig manufacturing method.
Figure 4:
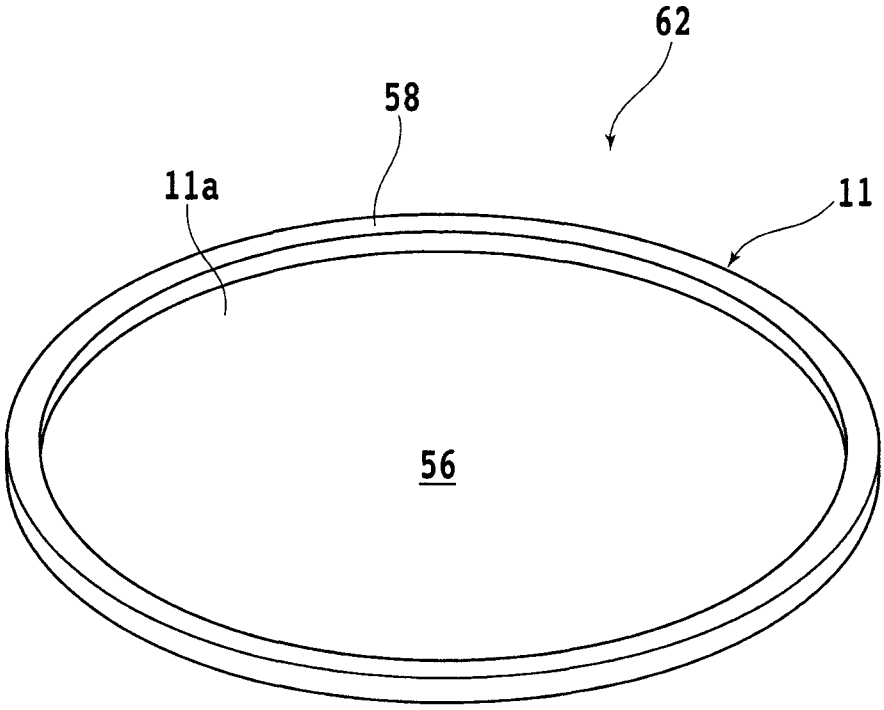
FIG. 4 is a perspective view of the holding jig obtained by performing the holding jig manufacturing method.

As shown in FIG. 2, the grinding wheel 22 is composed of a wheel base 51 and an abrasive ring 52 fixed to the lower surface of the wheel base 51. The abrasive ring 52 is composed of a plurality of abrasive members annularly arranged at given intervals along the outer circumference of the wheel base 51. The silicon wafer 11 is placed on the chuck table 36 set at the wafer mounting/demounting position A shown in FIG. 1 and is held under suction on the chuck table 36. Thereafter, the chuck table 36 is moved to the grinding position B in the Y direction. At the grinding position B, the chuck table 36 is rotated at 300 rpm, for example, in the direction shown by an arrow 37 and the grinding wheel 22 having the abrasive ring 52 is rotated at 6000 rpm, for example, in the direction shown by an arrow 53 as shown in FIGS. 2 and 3. At the same time, the grinding unit moving mechanism 32 is driven to bring the abrasive ring 52 into contact with the front side 11*a* of the wafer 11. Further, the grinding wheel 22 is fed downward by a predetermined amount at a predetermined feed speed.

The relation between the wafer 11 held on the chuck table 36 and the abrasive ring 52 of the grinding wheel 22 will now be described with reference to FIG. 3. The center P1 of rotation of the chuck table 36 and the center P2 of rotation of the abrasive ring 52 are deviated from each other as shown in FIG. 3. Further, the outer diameter of the abrasive ring 52 is set smaller than the diameter of a boundary circle 60 between a central area of the wafer 11 where the circular recess is to be formed and a peripheral area of the wafer 11 where the annular projection is to be formed. Further, the outer diameter of the abrasive ring 52 is set slightly larger than the radius of the boundary circle 60. Accordingly, the abrasive ring 52 passes through the center P1 of rotation of the chuck table 36.

As the result of this grinding, the front side 11*a* of the wafer 11 is ground at its central area to form a circular recess 56 having a predetermined depth (e.g., 50 μm for the thickness of the central area corresponding to the circular recess 56) and accordingly form an annular projection 58 around the circular recess 56.

Figure 5A:
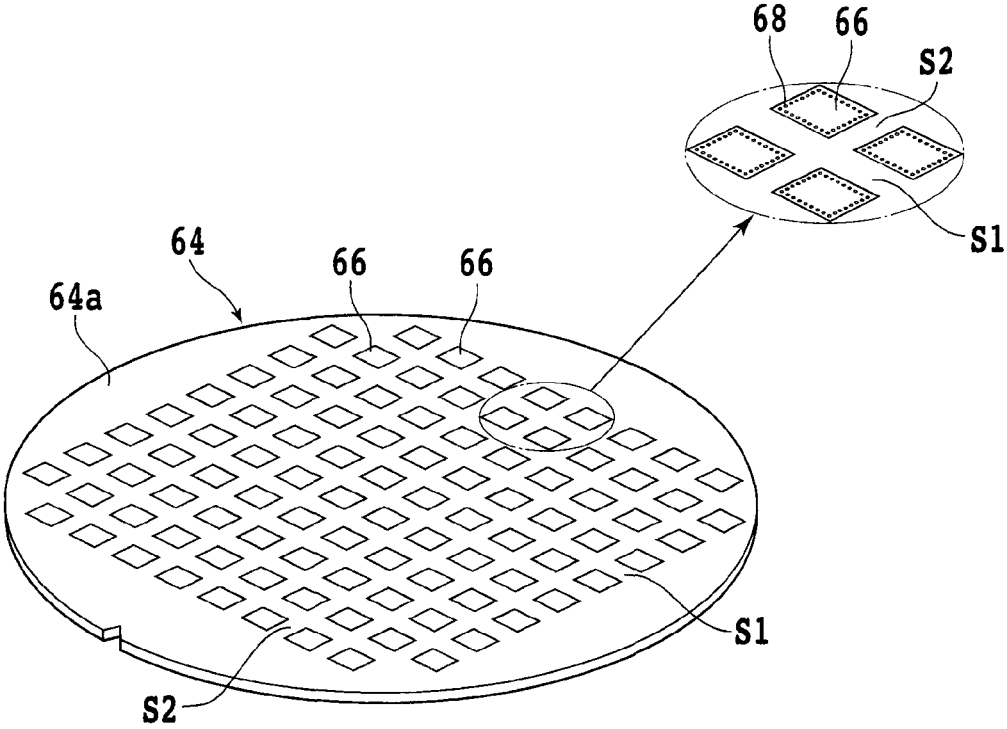
FIG. 5A is a perspective view of a wafer having bumps.

There will now be described some examples of a workpiece to be suitably ground by the grinding method of the present invention with reference to FIGS. 5A and 5B. FIG. 5A is a perspective view of a semiconductor wafer 64 as an example of the workpiece. As shown in FIG. 5A, a plurality of first streets S1 and a plurality of second streets S2 perpendicular to the first streets S1 are formed on the front side 64*a* of the semiconductor wafer 64, thereby partitioning a plurality of rectangular regions where a plurality of devices (chips) 66 are respectively formed. As shown in an enlarged view in FIG. 5A, a plurality of projecting bumps 68 are formed on the front side of each device 66 along the four sides thereof.

Figure 5B:
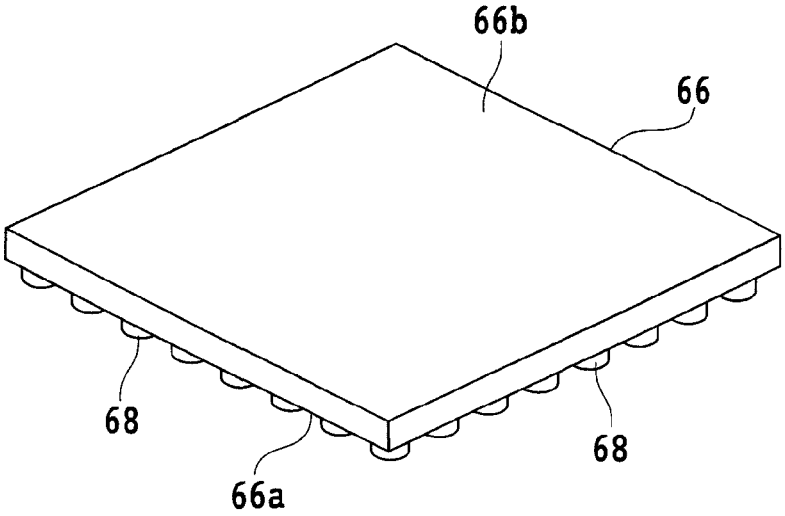
FIG. 5B is a perspective view of a chip having bumps.

Referring to FIG. 5B, there is shown a perspective view of the chip 66 as another example of the workpiece. In FIG. 5B, the back side 66*b* of the chip 66 is shown as the upper side. The chip 66 is formed by dicing the semiconductor wafer 64 shown in FIG. 5A by using a dicing apparatus. The plural bumps 68 are formed on the front side 66*a* of the chip 66 along the four sides thereof.

Figure 6A:
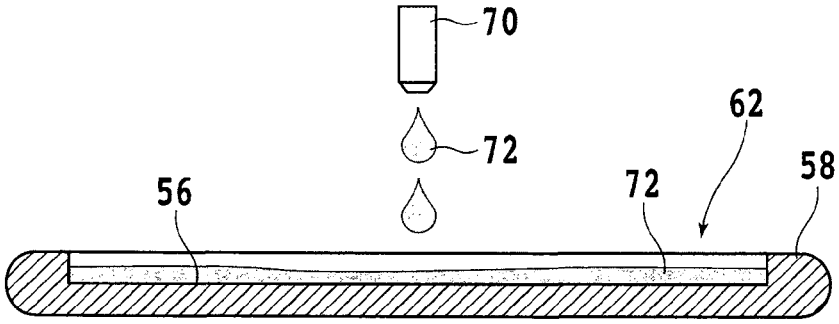
FIG. 6A is a sectional view showing a liquid curing agent supplying step.

The grinding method of the present invention will now be described in detail with reference to FIGS. 6A to 9B. As shown in FIG. 6A, a liquid curing agent 72 is supplied into the circular recess 56 of the holding jig 62 by a liquid curing agent supplying apparatus 70. For example, a liquid thermosetting resin cured by heating is preferably used as the liquid curing agent 72. In the case that the holding jig 62 is formed of a material capable of transmitting ultraviolet radiation, a liquid ultraviolet curing resin may be used as the liquid curing agent 72.

Figure 6B:
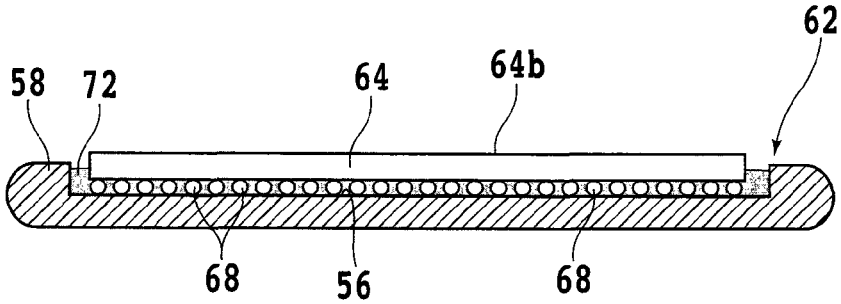
FIG. 6B is a sectional view showing a wafer setting step.

The holding jig 62 has the annular projection 58 surrounding the circular recess 56, so that the liquid curing agent 72 supplied into the circular recess 56 does not flow out of the circular recess 56 owing to the annular projection 58 functioning as a bank. After performing this liquid curing agent supplying step, the semiconductor wafer 64 having the bumps 68 on the front side 64*a* is set in the circular recess 56 of the holding jig 62 in the condition where the back side 64*b* of the semiconductor wafer 64 is exposed as shown in FIG. 6B. Alternatively, the plural chips 66 each having the bumps 68 on the front side 66*a* are set in the circular recess 56 of the holding jig 62 in the condition where the back side 66*b* of each chip 66 is exposed as shown in FIG. 6C.

Figure 6C:
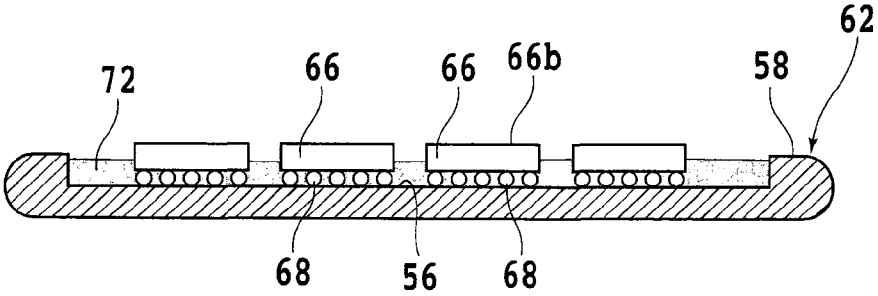
FIG. 6C is a sectional view showing a chip setting step.

In FIGS. 6B and 6C, the level of the liquid curing agent 72 in the circular recess 56 of the holding jig 62 is lower than the level of the back side of the wafer 64 or each chip 66. As a modification, the depth of the circular recess 56 of the holding jig 62 may be increased so that the level of the liquid curing agent 72 becomes higher than or equal to the level of the back side of the wafer 64 or each chip 66. That is, the wafer 64 or each chip 66 is embedded in the liquid curing agent 72. In this case, it is possible to prevent chipping of the periphery of the wafer 64 or each chip 66 due to grinding to be hereinafter described.

Figure 7A:
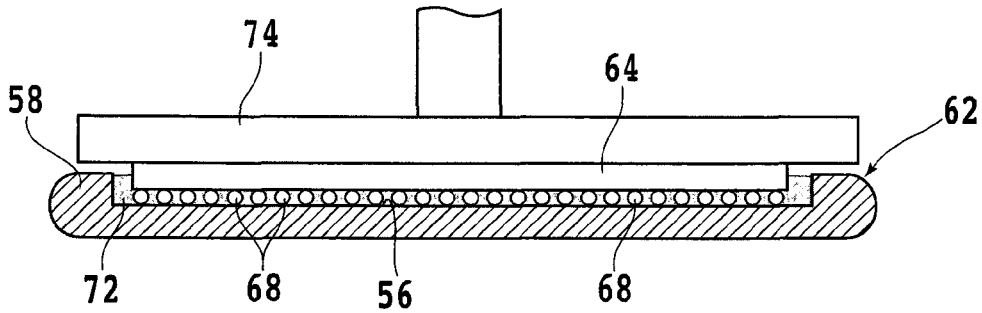
FIG. 7A is a sectional view showing a wafer pressing step.
Figure 7B:
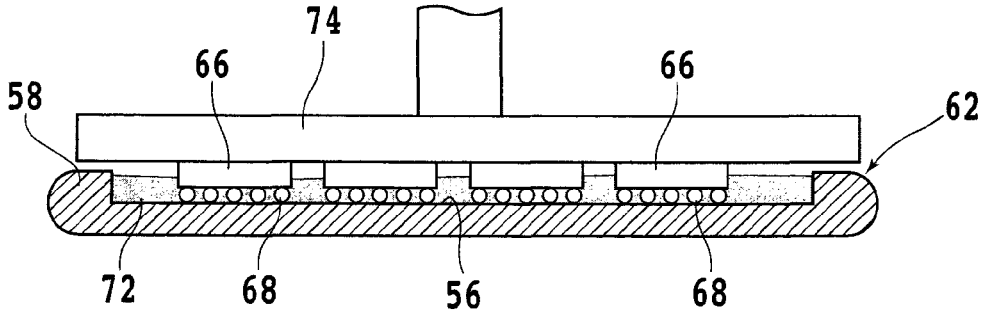
FIG. 7B is a sectional view showing a chip pressing step.

After performing this setting step, the wafer 64 or each chip 66 is preferably pressed on the holding jig 62 by using a press (pressing means) 74 as shown in FIGS. 7A and 7B. Accordingly, the bumps 68 come into close contact with the bottom surface of the circular recess 56 of the holding jig 62. However, this pressing step is not essential in the grinding method of the present invention.

After performing the setting step or after performing the setting step and the pressing step, the holding jig 62 is heated to a predetermined temperature to thereby cure the liquid curing agent 72, so that the wafer 64 or each chip 66 is fixed in the circular recess 56 of the holding jig 62 by a cured resin 72*a*. In the case that the holding jig 62 is formed of an ultraviolet radiation transmitting material and a liquid ultraviolet curing resin is used as the liquid curing agent 72, ultraviolet radiation is applied to the holding jig 62 from the back side thereof to thereby fix the wafer 64 or each chip 66 in the circular recess 56 of the holding jig 62.

Figure 8A:
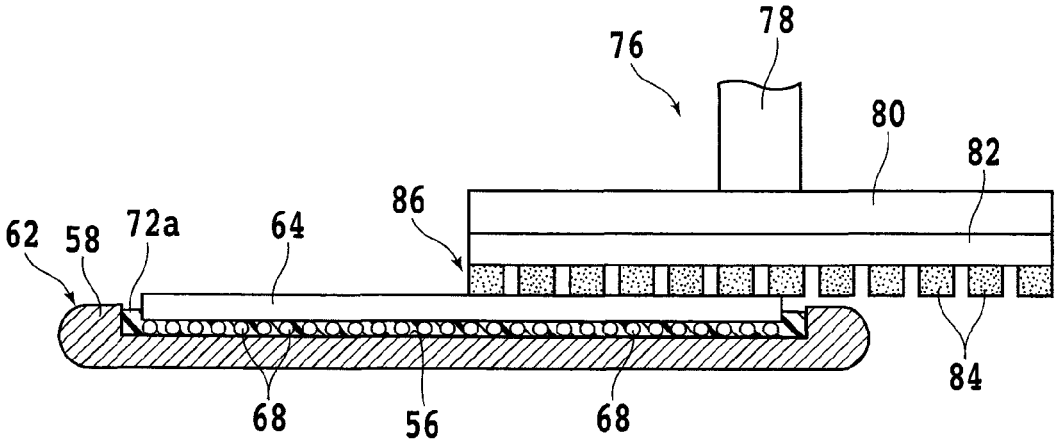
FIG. 8A is a sectional view showing a wafer grinding step.

After performing this fixing step, a grinding step is performed by using grinding means (grinding unit) 76 to grind the back side of the wafer 64 or each chip 66 and the annular projection 58 of the holding jig 62. Referring to FIG. 8A, there is shown a partially sectional side view in the condition where the back side of the wafer 64 is being ground. A wheel mount 80 is fixed to the lower end of a spindle 78 of the grinding unit 76, and a grinding wheel 86 is detachably mounted on the lower surface of the wheel mount 80. The grinding wheel 86 is composed of a base 82 and a plurality of abrasive members 84 fixed to the base 82. The grinding wheel 86 of the grinding unit 76 has a diameter larger than that of the grinding wheel 22 of the grinding unit 10 shown in FIG. 1.

As similar to the grinding of the wafer 11 described with reference to FIG. 2, the holding jig 62 is held under suction on the chuck table 36 of the grinding apparatus. Thereafter, the chuck table 36 holding the holding jig 62 is rotated at 300 rpm, for example, and the grinding wheel 86 is rotated at 6000 rpm, for example, in the same direction as that of the chuck table 36. At the same time, the grinding unit moving mechanism 32 is driven to bring the abrasive members 84 into contact with the back side 64*b* of the wafer 64.

Figure 8B:
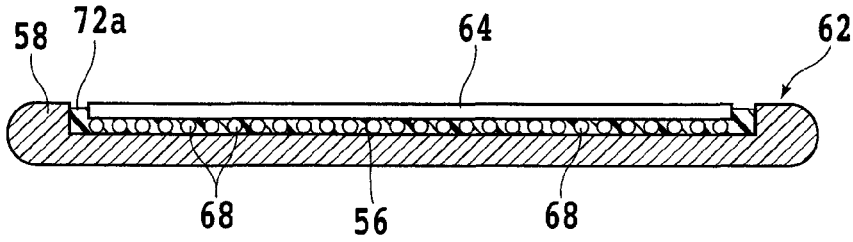
FIG. 8B is a sectional view showing a wafer obtained by performing the wafer grinding step.

Further, the grinding wheel 86 is fed downward by a predetermined amount at a predetermined feed speed, thereby grinding the back side 64*b* of the wafer 64. By continuing this grinding, the thickness of the wafer 64 is reduced and the abrasive members 84 come into contact with the annular projection 58 of the holding jig 62. However, since the holding jig 62 is formed from a silicon wafer, the annular projection 58 of the holding jig 62 is ground simultaneously with the grinding of the wafer 64 until the thickness of the wafer 64 is reduced to a predetermined thickness (e.g., 50 μm). FIG. 8B shows a condition obtained after finishing this grinding step.

Figure 9A:
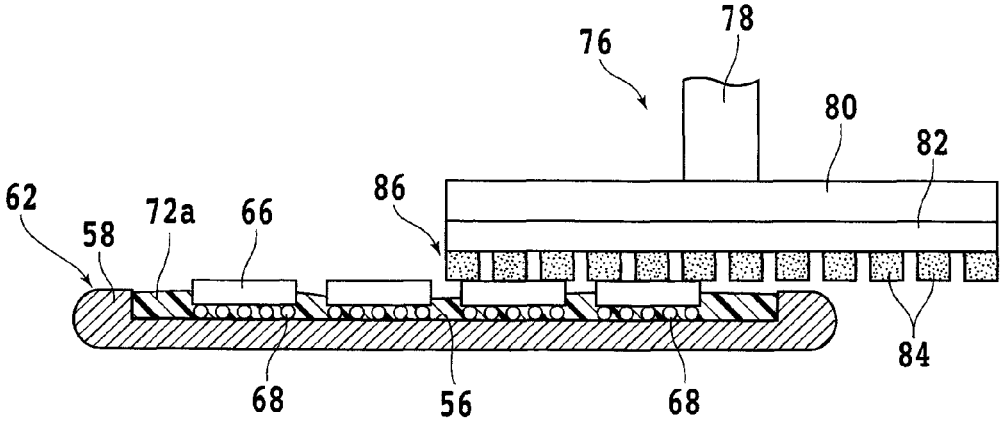
FIG. 9A is a sectional view showing a chip grinding step.
Figure 9B:
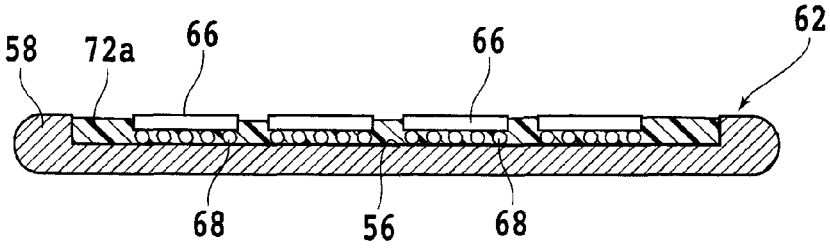
FIG. 9B is a sectional view showing chips obtained by performing the chip grinding step.

Referring to FIG. 9A, there is shown a partially sectional side view in the condition where the back sides of the plural chips 66 fixed to the holding jig 62 are being ground by the grinding wheel 86. This grinding step for the chips 66 is performed under the conditions similar to those of the grinding step for the wafer 64 described above with reference to FIGS. 8A and 8B. However, in the case of the grinding step for the chips 66, the chips 66 are preferably embedded in the cured resin 72*a* to prevent chipping of the periphery of each chip 66. FIG. 9B shows a condition obtained after finishing the grinding step.

After finishing the grinding step, the wafer 64 or each chip 66 may be removed from the holding jig 62 by using a curing agent capable of swelling with hot water as the liquid curing agent 72, for example. In this case, by immersing the holding jig 62 holding the wafer 64 or each chip 66 into hot water, the wafer 64 or each chip 66 can be removed from the holding jig 62.

The present invention is not limited to the details of the above described preferred embodiments. The scope of the invention is defined by the appended claims and all changes and modifications as fall within the equivalence of the scope of the claims are therefore to be embraced by the invention.

What is claimed is:

1. A grinding method of grinding the back side of a workpiece having a projection on the front side thereof, said grinding method comprising:

a holding jig preparing step of preparing a holding jig having a circular recess and an annular projection surrounding said circular recess;

a setting step of setting said workpiece in said circular recess of said holding jig in the condition where the back side of said workpiece is exposed;

a liquid curing agent supplying step of supplying a liquid curing agent into said circular recess before or after performing said setting step;

a fixing step of curing said liquid curing agent in the condition where said workpiece is set in said circular recess and said liquid curing agent is present in said circular recess, thereby fixing said workpiece in said circular recess; and a holding step of applying suction to said holding jig to hold said holding jig, with said workpiece fixed thereon, to a chuck table of a grinding apparatus;

a grinding step of grinding the back side of said workpiece and said annular projection of said holding jig by using grinding means associated with the grinding apparatus, after performing said fixing step.

2. The grinding method according to claim 1, wherein said workpiece includes a chip having a plurality of electrodes projecting from the front side thereof.

3. The grinding method according to claim 1, wherein said holding jig includes a silicon wafer.

4. The grinding method according to claim 1, wherein said fixing step of curing said liquid curing agent comprises heating said holding jig to a predetermined temperature to thereby cure the liquid curing agent.

5. The grinding method according to claim 1, wherein said fixing step of curing said liquid curing agent comprises applying ultraviolet radiation to a back side of said holding jig, where the back side of said holding jig is opposite of the side with said circular recess.

* * * * *